United States Patent [19]

Ridge et al.

[11] 4,335,484

[45] Jun. 22, 1982

[54] FENCE PICKET ROLLER PAINTER

[76] Inventors: Edward J. Ridge, 351 Ash St.; Graham H. Wilton, 180 Greenwood Ave., both of Winnipeg, Manitoba, Canada

[21] Appl. No.: 173,033

[22] Filed: Jul. 28, 1980

[30] Foreign Application Priority Data

Oct. 26, 1979 [CA] Canada ..... 338505

[51] Int. Cl.[3] ..... B05C 9/04

[52] U.S. Cl. ..... 15/230.11

[58] Field of Search ..... 15/230, 230.11; 29/110, 29/110.5; 401/9, 10

[56] References Cited

U.S. PATENT DOCUMENTS

| | | | |
|---|---|---|---|
| 2,788,539 | 4/1957 | Santina | 15/230.11 |
| 2,823,402 | 2/1958 | Phillips | 15/230.11 X |
| 3,358,312 | 12/1967 | Parr | 15/230.11 |

FOREIGN PATENT DOCUMENTS

| | | | |
|---|---|---|---|
| 2823277 | 11/1979 | Fed. Rep. of Germany | 15/230.11 |
| 136108 | 6/1979 | German Democratic Rep. | 15/230.11 |
| 80213 | 5/1952 | Norway | 15/230.11 |

*Primary Examiner*—Billy J. Wilhite

*Attorney, Agent, or Firm*—Stanley G. Ade

[57] ABSTRACT

Conventionally, fence pickets are painted by brush on the individual faces and side edges. Alternatively, the front and rear faces may be painted by a roller coater but, due to space restrictions, the side edges must still be brush-painted by hand. The present device consists of a bifurcated handle carrying for rotation a main transversely situated roller coater, with a pair of picket-side-edge-engaging rollers extending forwardly of the main roller and situated at right angles thereto, one adjacent each end thereof. This enables one face and both side edges to be painted at the same time. The legs carrying the edge rollers and the main roller are angulated with respect to the handle so that when the one face and the two side edges have been painted, the roller assembly may be turned over so that the main roller may engage the opposite face of the picket with the edge rollers held clear of the side edges thereof.

28 Claims, 6 Drawing Figures

FIG. 1
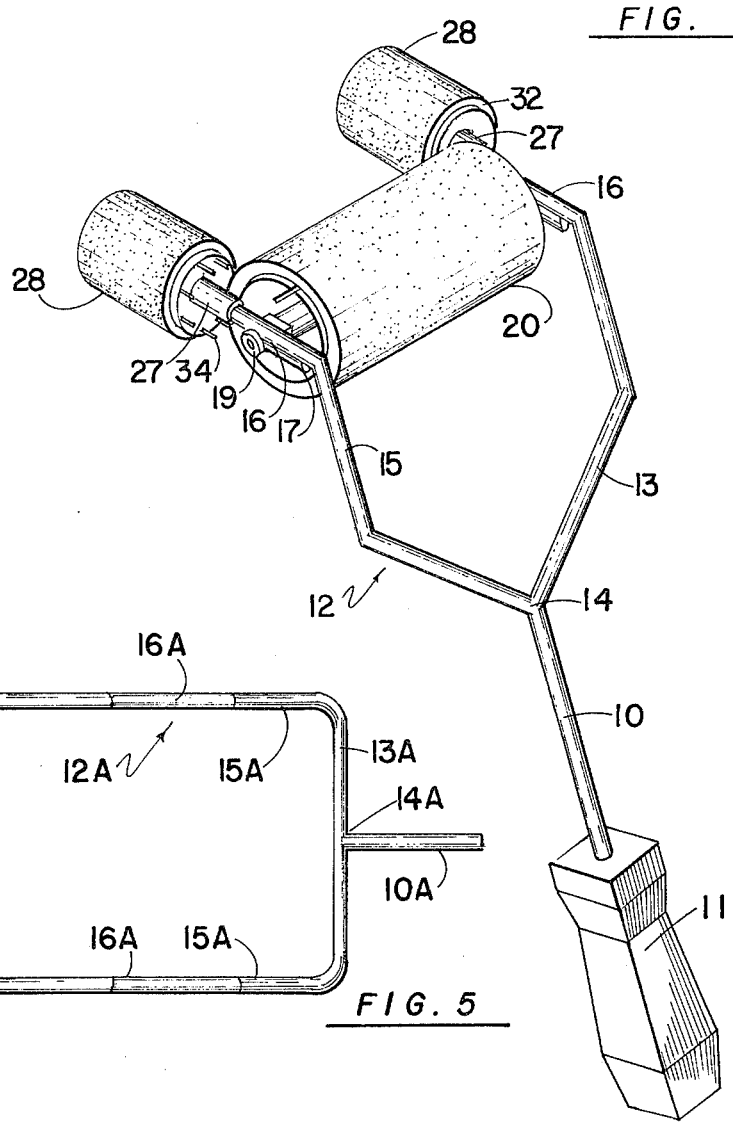
FIG. 5
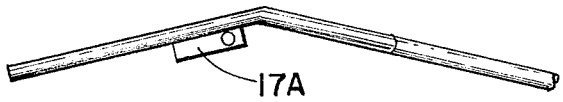
FIG. 6

FENCE PICKET ROLLER PAINTER

BACKGROUND OF THE INVENTION

This invention relates to new and useful improvements in fence picket rollers, particularly rollers in which one side face and one or both side edges of the fence picket may be painted at the same time by a single roller assembly.

It is well known that hand painting of a picket fence either by brush or roller is time consuming inasmuch as all four sides of each picket have to be painted individually.

Although a roller is faster than a brush when the front and rear surfaces are being painted, nevertheless a brush is still required in order to engage the side edges of the pickets and this also is time consuming and labour intensive.

The present invention has a main roller which is journalled between bifurcated legs of a handle and adapted to engage either the front or rear surface of the picket. Formed upon extensions of the bifurcated legs and having the axes normal to the axis of the main roller, are a pair of smaller rollers which are adapted to engage the side edges of a picket when the main transverse roller is engaging the front or rear face thereof. This means that the two side edges and one face of a picket can be painted at the same time whereupon it is only necessary to use the main roller to paint the other side face.

The legs are preferably resilient so that a slight adjustment is provided for the width of the two side edge rollers one from the other and the legs are preferably angulated so that the assembly can be reversed when the second face is being painted without the edge rollers engaging the edges which have already been painted in conjunction with the other face.

SUMMARY OF THE INVENTION

The present device overcomes disadvantages inherent with such painting and in accordance with the invention there is provided a paint roller assembly for fence pickets which include a front face, a rear face and two side edges; comprising in combination a handle component, a face engaging paint roller journalled for rotation within said handle component, at least one picket-side-edge-engaging paint roller journalled for rotation in said handle assembly with the axis of said side-edge-engaging roller being situated normal to the axis of said face engaging roller and adjacent one end thereof.

The device is simple in construction, economical in manufacture and otherwise well suited to the purpose for which it is designed.

With the foregoing in view, and other advantages as will become apparent to those skilled in the art to which this invention relates as this specification proceeds, the invention is herein described by reference to the accompanying drawings forming a part hereof, which includes a description of the preferred typical embodiment of the principles of the present invention, in which:

DESCRIPTION OF THE DRAWINGS

FIG. 1 is an isometric view of the assembly.

FIG. 5 is a plan view of the preferred embodiment of the frame assembly per se.

FIG. 6 is a side view of FIG. 5.

In the drawings like characters of reference indicate corresponding parts in the different figures.

DETAILED DESCRIPTION

Figure 2:
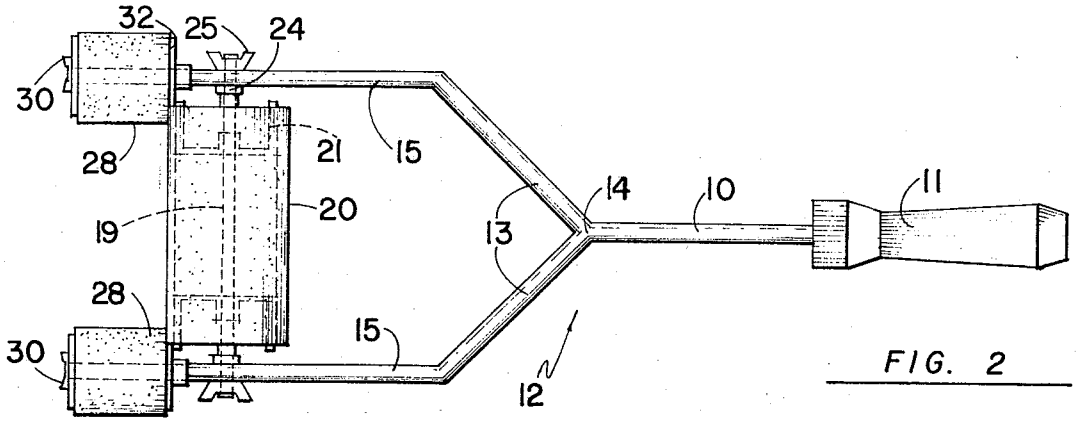
FIG. 2 is a top plan view thereof.
Figure 3:
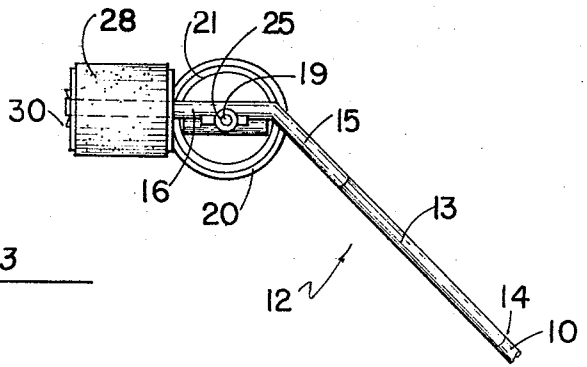
FIG. 3 is a side elevation thereof.
Figure 4:
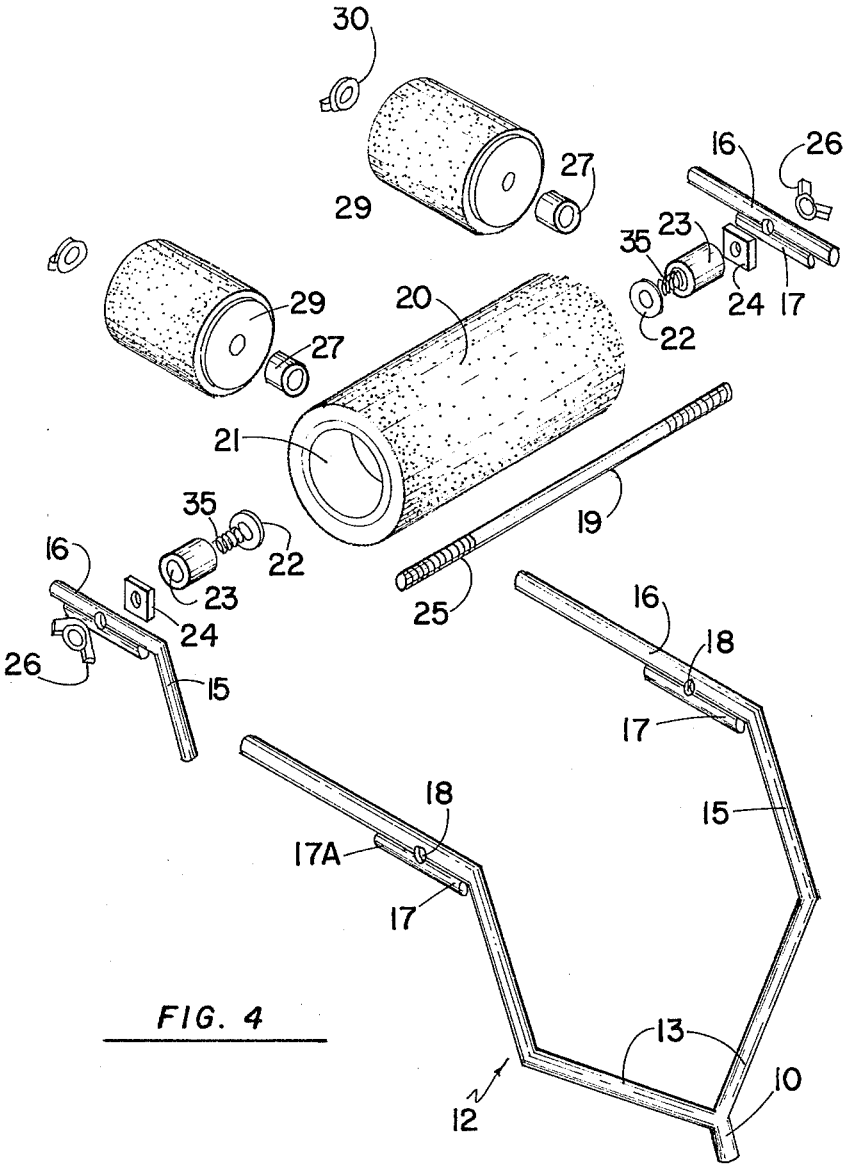
FIG. 4 is a fragmentary isometric exploded view of the assembly.

Proceeding therefore to describe the invention in detail, reference character 10 illustrates a handle shank engageable within a handle portion 11 and having a bifurcated leg assembly collectively designated 12, extending from the distal end of the handle shank 10. The bifurcated leg assembly includes the two legs which in turn include inner portions 13 which diverge outwardly from the distal end 14 off the shank 10 and then continue with portions 15 which are substantially spaced and parallel to one another. The outer or bearing portions 16 are also spaced and parallel to one another but are angulated approximately 45° from the plane of the portions 13 and 15.

Small reinforcing sections 17 are secured as by welding upon the undersides of the inner ends of the portions 16 and drilled apertures 18 are provided transversely through a portion of these reinforcing sections 17 and the support portions 16, within which the screw threaded ends of a main spindle 19 extend. However, other spindle support means may be utilized.

A main transverse roller 20 of conventional construction includes end caps 21 through which spindle 19 engages thus mounting the roller for rotation upon the spindle. Washers 22, sleeves 23 and nuts 24 engage over each threaded end portion 25 of the spindle 19 and wing nuts or the like 26 engage the screw threaded ends of the spindle which extend beyond the drillings 18, it being understood that the washers, sleeves and nuts 24 are situated between the end caps 21 of the roller and the inner surfaces of the mounting leg portions 16.

Sleeves 27 engage the distal ends of the mounting portions 16 and engage against the outer ends 17A of the reinforcements 17 and small picket edge engaging rollers 28 are journalled for rotation upon the leg portions 16 via end caps 29 in the usual manner with self-threading clips 30 or the like engaging over the distal ends to hold the rollers in position between the end caps 30 and the sleeves 27. All three rollers 28 may be covered by conventional paint roller material depending upon design parameters.

The bifurcated portions of the legs are preferably resilient and normally biassed outwardly from one another and adjustment of the nuts 24 together with wing nuts 26 will allow limited adjustment of the width characteristics between the picket edge rollers 28 so that slight variations in width can be accommodated.

It will be observed that the end peripheries 31 of the main transverse roller 20 engages the inner end peripheries 32 of the picket edge rollers 28 thus providing rotation to the edge rollers 28 when the main roller 20 is rolled along one face of the fence picket.

If desired, one or more projections 33 may extend outwardly from each end cap 21 of the main roller, engageable with any one of a plurality of projections 34 extending inwardly from the inner end caps 20 of the edge rollers 28 thus urging the edge rollers around if, by chance, they become slightly jammed due to obstructions such as dried paint or the like.

In operation, the rollers are coated with paint from a roller tray by rolling the main roller to load same and at the same time loading the side rollers which are rotating in the paint at the same time. The main roller is engaged with one face of a picket with the edge rollers, duly adjusted, engaging the two side edges so that painting the one face, will also roll paint onto the side edges.

The assembly is then reversed so that the main transverse roller alone engages the other face of the picket thus completing the painting of the four sides.

FIGS. 5 and 6 show the preferred configuration of the frame assembly which includes the handle shank 10A and the bifurcated leg constructions extending therefrom.

In this embodiment, the bifurcated leg construction collectively designated 12A includes the inner portions 13A which extend substantially at right angles from the end 14A of the shank 10A. The portions 15A then extend parallel to one another and parallel to the handle shank 10A, one from each end of the inner portions 13A with the outer or bearing portions 16A extending from the ends of the inner portions and being angulated therefrom as clearly shown in FIG. 6. It will be noted that the inner portions 15A are considerably shorter than portions 15 in FIG. 1 which are extended by the diverging portion 13 in the previous embodiment.

The roller assembly is mounted between the reinforcing sections 17A in a manner similar to that hereinbefore described and the remainder of the assembly is similar.

The one advantage of this particular configuration is that it enables the main roller 20 (not illustrated in FIGS. 5 and 6) to be used with the tool reversed, on staggered fences in which one vertical picket is situated on one side of the horizontal rails and the next adjacent picket on the opposite side thereof and slightly overlapping same.

Finally, it should be observed that small springs 35 are situated between the washers 22 and the spacers 23 in order to centre the roller 20 on the spindle 19.

The device may also be used with only one side roller 28 in place so that it can be used to paint fence pickets of a width different from the width which may be engaged by a pair of rollers. With this variation, one face and one side edge may be painted and then the other face and the other side edge may be painted.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

We claim as our invention:

1. A paint roller assembly for fence pickets which include a front face, a rear face and two side edges; comprising in combination a handle assembly, a face engaging paint roller journalled for rotation within said handle component, a pair of picket-side-edge-engaging paint rollers journalled for rotation in said handle assembly in spaced apart relationship and being situated one adjacent each edge of said face engaging roller, with the axis of said side-edge-engaging rollers being situated normal to the axis of said face engaging roller and means cooperating between the edge-engaging rollers and the face engaging roller whereby rotation of said face-engaging roller, rotates said edge-engaging rollers, said face engaging roller being situated inboard of said edge-engaging rollers, said handle assembly including a pair of spaced apart leg portions, said face engaging roller being journalled for rotation between said spaced apart leg portions inwardly from the distal ends thereof, said side-edge-engaging rollers being journalled for rotation, one upon the distal end of each of said leg portions.

2. The roller assembly according to claim 1 in which the periphery of the inner ends of said side-edge-engaging rollers engage the periphery of the adjacent end of said face engaging roller whereby rotation of said face engaging roller urges rotation of said side-edge-engaging roller.

3. The roller assembly according to claim 2 in which the means cooperating between the edge-engaging roller and the face-engaging roller includes means extending from the ends of said face engaging roller engageable with means extending from the inner end of said side-edge-engaging rollers to at least partially rotate said side-edge-engaging rollers each revolution of said face engaging roller.

4. The roller assembly according to claims 1 or 2 which include means to adjust the distance between said two side-edge-engaging rollers, within limits.

5. The roller assembly according to claim 1 in which said handle assembly includes a main portion, said spaced apart leg portions extending from said main portion and including a pair of diverging portions, a pair of spaced and parallel portions extending from the ends of said diverging portions, and a pair of spaced and parallel roller carrying portions extending from the distal ends of said spaced and parallel portions.

6. The roller assembly according to claim 5 which includes means to adjust the distance between said two-side-edge-engaging rollers, within limits, said last mentioned means including said leg portions being resilient and normally urging said roller carrying portions apart, a spindle extending between said roller carrying portions mounting said face engaging roller for rotation thereon and adjustable means on the ends of said spindle controlling the spaced apart relationship of said roller carrying portions and hence the distance between the said two side-edge-engaging rollers.

7. The roller assembly according to claim 6 in which the means cooperating between the edge-engaging roller and the face-engaging roller includes means extending from the ends of said face engaging roller engageable with means extending from the inner end of said side-edge-engaging rollers to at least partially rotate said side-edge-engaging rollers each revolution of said face engaging roller.

8. The roller assembly according to claim 5 in which the means cooperating between the edge-engaging roller and the face-engaging roller includes means extending from the ends of said face engaging roller engageable with means extending from the inner end of said side-edge-engaging rollers to at least partially rotate said side-edge-engaging rollers each revolution of said face engaging roller.

9. The roller assembly according to claim 1 in which said face engaging roller and said side-edge-engaging rollers are journalled for rotation upon said spaced and parallel roller carrying portions.

10. The roller assembly according to claim 9 in which said roller carrying portions lie in a plane situated at an obtuse angle to the plane of said spaced and parallel portions.

11. The roller assembly according to claim 10 which includes means to adjust the distance between said two side-edge-engaging rollers, within limits, said last mentioned means including said leg portions being resilient and normally urging said roller carrying portions apart, a spindle extending between said roller carrying portions mounting said face engaging roller for rotation thereon and adjustable means on the ends of said spindle controlling the spaced apart relationship of said roller carrying portions and hence the distance between the said two side-edge-engaging rollers.

12. The roller assembly according to claim 11 in which the means cooperating between the edge-engaging roller and the face-engaging roller includes means extending from the ends of said face engaging roller engageable with means extending from the inner end of said side-edge-engaging rollers to at least partially rotate said side-edge-engaging rollers each revolution of said face engaging roller.

13. The roller assembly according to claim 12 in which said roller carrying portions lie in a plane situated at an obtuse angle to the plane of said spaced and parallel portions.

14. The roller assembly according to claim 10 in which the means cooperating between the edge-engaging roller and the face-engaging roller includes means extending from the ends of said face engaging roller engageable with means extending from the inner end of said side-edge-engaging rollers to at least partially rotate said side-edge-engaging rollers each revolution of said face engaging roller.

15. The roller assembly according to claim 9 which includes means to adjust the distance between said two side-edge-engaging rollers, within limits, said last mentioned means including said leg portions being resilient and normally urging said roller carrying portions apart, a spindle extending between said roller carrying portions mounting said face engaging roller for rotation thereon and adjustable means on the ends of said spindle controlling the spaced apart relationship of said roller carrying portions and hence the distance between the said two side-edge-engaging rollers.

16. The roller assembly according to claim 15 in which the means cooperating between the edge-engaging roller and the face-engaging roller includes means extending from the ends of said face engaging roller engageable with means extending from the inner end of said side-edge-engaging rollers to at least partially rotate said side-edge-engaging rollers each revolution of said face engaging roller.

17. The roller assembly according to claim 9 in which the means cooperating between the edge-engaging roller and the face-engaging roller includes means extending from the ends of said face engaging roller engageable with means extending from the inner end of said side-edge-engaging rollers to at least partially rotate said side-edge-engaging rollers each revolution of said face engaging roller.

18. The roller assembly according to claim 1 in which said roller carrying portions lie in a plane situated at an obtuse angle to the plane of said spaced and parallel portions.

19. The roller assembly according to claim 18 which includes means to adjust the distance between said two side-edge-engaging rollers, within limits, said last mentioned means including said leg portions being resilient and normally urging said roller carrying portions apart, a spindle extending between said roller carrying portions mounting said face engaging roller for rotation thereon and adjustable means on the ends of said spindle controlling the spaced apart relationship of said roller carrying portions and hence the distance between the said two side-edge-engaging rollers.

20. The roller assembly according to claim 19 in which the means cooperating between the edge-engaging roller and the face-engaging roller includes means extending from the ends of said face engaging roller engageable with means extending from the inner end of said side-edge-engaging rollers to at least partially rotate said side-edge-engaging rollers each revolution of said face engaging roller.

21. The roller assembly according to claim 18 in which the means cooperating between the edge-engaging roller and the face-engaging roller includes means extending from the ends of said face engaging roller engageable with means extending from the inner end of said side-edge-engaging rollers to at least partially rotate said side-edge-engaging rollers each revolution of said face engaging roller.

22. The roller assembly according to claim 1 which includes means to adjust the distance between said two edge-engaging rollers, within limits, said last mentioned means including said leg portions being resilient and normally urging said leg portions apart, a spindle extending between said leg portions mounting said face engaging roller for rotation thereon, and adjustment means on the ends of said spindle controlling the spaced apart relationship of said leg portions and hence the distance between said two side-edge-engaging rollers.

23. The roller assembly according to claim 22 in which the means cooperating between the edge-engaging roller and the face-engaging roller includes means extending from the ends of said face engaging roller engageable with means extending from the inner end of said side-edge-engaging rollers to at least partially rotate said side-edge-engaging rollers each revolution of said face engaging roller.

24. The roller assembly according to claim 1 in which the means cooperating between the edge-engaging roller and the face-engaging roller includes means extending from the ends of said face engaging roller engageable with means extending from the inner end of said side-edge-engaging rollers to at least partially rotate said side-edge-engaging rollers each revolution of said face engaging roller.

25. The roller assembly according to claims 6, 15 or 19 in which said roller carrying portions lie in a plane situated at an obtuse angle to the plane of said spaced and parallel portions.

26. The roller assembly according to claims 11, 3 or 8 in which said roller carrying portions lie in a plane situated at an obtuse angle to the plane of said spaced and parallel portions.

27. The roller assembly according to claims 21, 14 or 23 in which said roller carrying portions lie in a plane situated at an obtuse angle to the plane of said spaced and parallel portions.

28. The roller assembly according to claims 7, 16 or 20 in which said roller carrying portions lie in a plane situated at an obtuse angle to the plan of said spaced and parallel portions.

* * * * *